US006241233B1

(12) United States Patent
DeVlaam

(10) Patent No.: US 6,241,233 B1
(45) Date of Patent: Jun. 5, 2001

(54) STACK FORMING AND REMOVING APPARATUS WITH UNDERSHEET PLACEMENT

(75) Inventor: Henk DeVlaam, Et Almere (NL)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/348,922

(22) Filed: Jul. 6, 1999

(30) Foreign Application Priority Data

Jul. 3, 1998 (CH) ..... 1429/98

(51) Int. Cl.[7] ..... B65H 33/04

(52) U.S. Cl. ..... 270/58.05; 270/58.31; 414/789.5; 414/789.9; 414/790.1

(58) Field of Search ..... 270/58.05, 58.31, 270/58.32; 414/789.5, 789.9, 790, 790.1, 790.2, 790.3; 53/540, 541

(56) References Cited

U.S. PATENT DOCUMENTS

| | | | | |
|---|---|---|---|---|
| 3,979,112 | * | 9/1976 | Munn et al. | 270/58.05 |
| 3,980,183 | | 9/1976 | Anikanov et al. . | |
| 4,140,234 | | 2/1979 | Steinhart . | |
| 4,183,704 | | 1/1980 | Steinhart . | |
| 4,565,130 | | 1/1986 | Leu . | |
| 4,569,622 | * | 2/1986 | Buck | 414/790.2 X |
| 4,708,561 | * | 11/1987 | Merkli et al. | 414/790.3 |
| 4,787,810 | * | 11/1988 | Cawley et al. | 414/789.8 X |
| 5,445,053 | | 8/1995 | Kallner . | |
| 5,507,616 | | 4/1996 | Perobelli et al. . | |
| 5,911,557 | * | 6/1999 | Gammerler | 414/744.6 |
| 6,082,080 | * | 7/2000 | Holter et al. | 53/540 |

* cited by examiner

*Primary Examiner*—Christopher P. Ellis
*Assistant Examiner*—Patrick Mackey
(74) *Attorney, Agent, or Firm*—Alston & Bird LLP

(57) ABSTRACT

An apparatus for stacking flat printed products, wherein a stack (22) is ejected from a stacking well (12) by means of an ejector (30), and a cover sheet (28) is pulled into the stacking well (12) as the ejector ejects the previously formed stack. The next stack (22) then comes to lie on this cover sheet (28). Arranged on the ejector (30) is a support (38) having a driving pin (40) which points downward. In each case, a cover sheet (28) is pinned on to said driving pin (40) by means of a support plate (50) which can be lifted and on which the cover sheet is positioned. By changing the position of a stripping lever (46) after the stack (22) has been ejected, the cover sheet (28), which has been pulled into the stacking well (12), is stripped off the driving pin (40).

9 Claims, 3 Drawing Sheets

A
16
20
22
19
12
18
18
10
10
30
14'
32
36
14
38
42
106
74
20
40
28
26
24
28
46
IV
54
66
50
50
52
106

A
20
16
30
18
10
12
38
36
32
36
40
28
28
74
64
68
46
46'
24
26
66
54
50
52

22
10
12
28
34
10
32
38
36
42
58
40
A
68
56
30
30
36
10
10
50

STACK FORMING AND REMOVING APPARATUS WITH UNDERSHEET PLACEMENT

BACKGROUND OF THE INVENTION

The present invention relates to an apparatus for stacking flat articles, especially printed products such as newspapers, magazines and the like, and providing the stacks with individual cover sheets.

Apparatuses for stacking flat articles are generally known in a very wide range of embodiments. They often have a stacking well, either into which a feed device for inserting the articles to be stacked opens directly or above which a pre-stacking device is provided, in which a pre-stack is formed from articles which have been supplied, said pre-stack then being deposited into the stacking well, for example by opening an intermediate floor. The floor of the stacking well is usually formed by a plate or parallel carrying rails. In order to convey the formed stack out of the stacking well, an ejector is often provided which, as viewed in the ejection direction, comes to bear on the rear of the stack and can be moved through the stacking well. As it does so, it pushes the stack out of the stacking well, with the lowest product sliding on the well floor.

U.S. Pat. No. 4,565,130 discloses a stacking apparatus of this type. In addition, this patent discloses an apparatus for preparing and depositing a cover sheet in each case on each stack of articles produced. This apparatus has a cover sheet conveyor, which opens laterally into the stacking well at the top end of the latter. In the cover sheet conveyor, the cover sheets are conveyed in a guide gap by means of pairs of driven rollers and compressed-air streams. Mention is made of the fact that—if the cover sheet is intended to come to lie underneath the stack to be formed—the apparatus can be designed in such a way that the outlet opens into the stacking well at the bottom end of the latter.

It is therefore an object of the present invention to provide an apparatus of the described type which is of simple construction.

SUMMARY OF THE INVENTION

The above and other objects and advantages of the present invention are achieved by the provision of a stacking apparatus which acts to pull an undersheet into the stacking well at the same time as the stack is ejected from the stacking well, and so that the undersheet comes to lie on the well floor. The stack formed in the apparatus then no longer comes to lie directly on the well floor but on the undersheet. This therefore ensures careful handling of the articles when they are being ejected or conveyed out of the stacking well and during their further conveyance.

In addition, an item of information may be added to the stack at the same time.

The undersheet may be a protective sheet, one - or more than one—cover sheet or the like, optionally provided with information.

BRIEF DESCRIPTION OF THE DRAWINGS

The apparatus will be explained in more detail with reference to an exemplary embodiment illustrated in the drawings, in which, in purely schematic form.

DETAILED DESCRIPTION OF THE PREFERRED EMBODIMENTS

Figure 1:
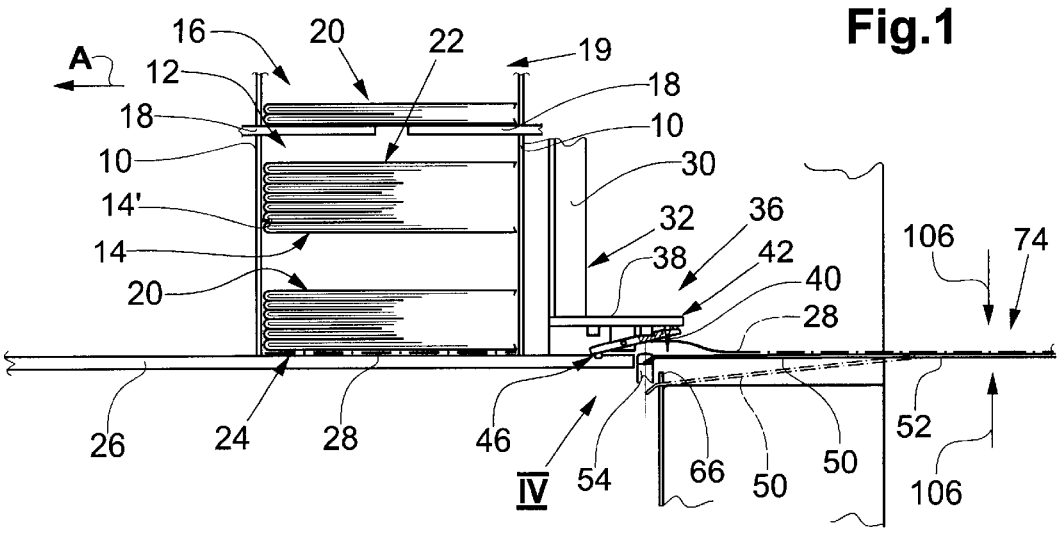
FIG. 1 shows a front view of a stacking well of a stacking apparatus, an ejector located in the standby position and an insertion device for inserting a sheet into the stacking well when the stack is ejected from the latter.
Figure 2:
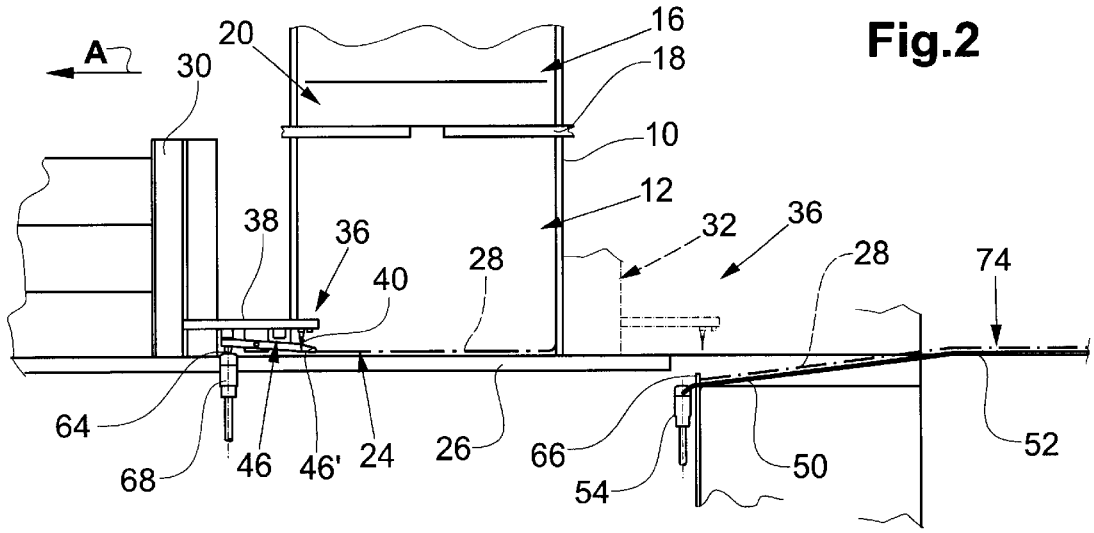
FIG. 2 shows, in an illustration identical to FIG. 1, the part, shown there, of the stacking well following the ejection of a stack from the stacking well, and with a cover sheet pulled into the stacking well.
Figure 3:
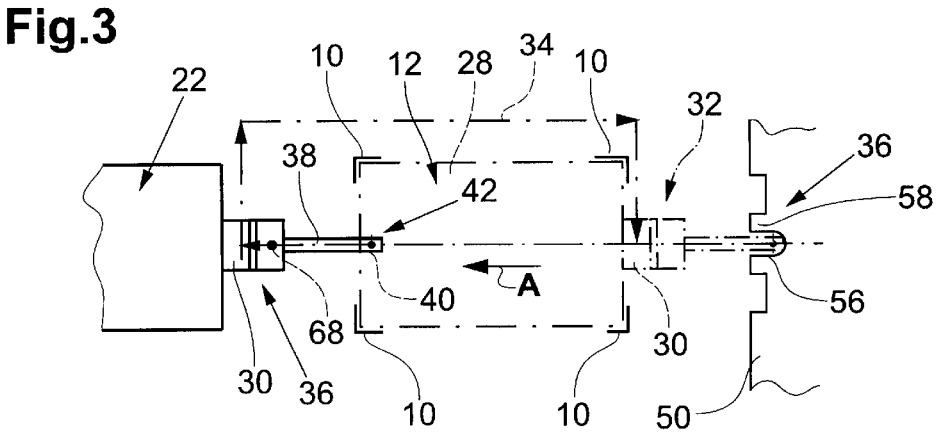
FIG. 3 shows a plan view of the part, shown in FIGS. 1 and 2, of the stacking apparatus.

FIGS. 1 to 3 show a stacking well 12, bounded by angle sections 10 running in the vertical direction, of a stacking apparatus for forming stacks from flat products 14 which are supplied, printed products in the present case. Arranged above the stacking well 12 is a pre-stacking space 16, which is bounded at the bottom by slide plates 18. As is indicated symbolically by the arrow 19, in each case a specific number of products 14 are inserted by means of a conveying device (not shown), for example a conveyor belt, into the prestacking space 16, where a pre-stack 20 is formed on the slide plates 18 pushed into the pre-stacking space 16. As soon as said pre-stack has been formed, the slide plates 18 are pulled out of the pre-stacking space 16 in a known way, as a result of which the prestack 20 is deposited into the stacking well 12. If the stack 22 in the stacking well 12 is to be formed from two or more pre-stacks, the folds 14' of the products 14 within each pre-stack 20 being aligned in the same direction, but being arranged on opposite sides from pre-stack to pre-stack 20, it is possible, for example, for the pre-stacking space 16 with the slide plates 18 and the stacking well 12 to be rotatable relative to one another in a known way about a vertical center axis.

The stacking well 12 is bounded at the bottom by a well floor 24 which is formed by carrying rails 26 which run parallel to one another and at a distance from one another in an ejection direction A. In the stacking well 12, a cover sheet 28 rests on the well floor 24. The stack 22 in turn rests on the cover sheet 28 (FIG. 1).

Figure 4:
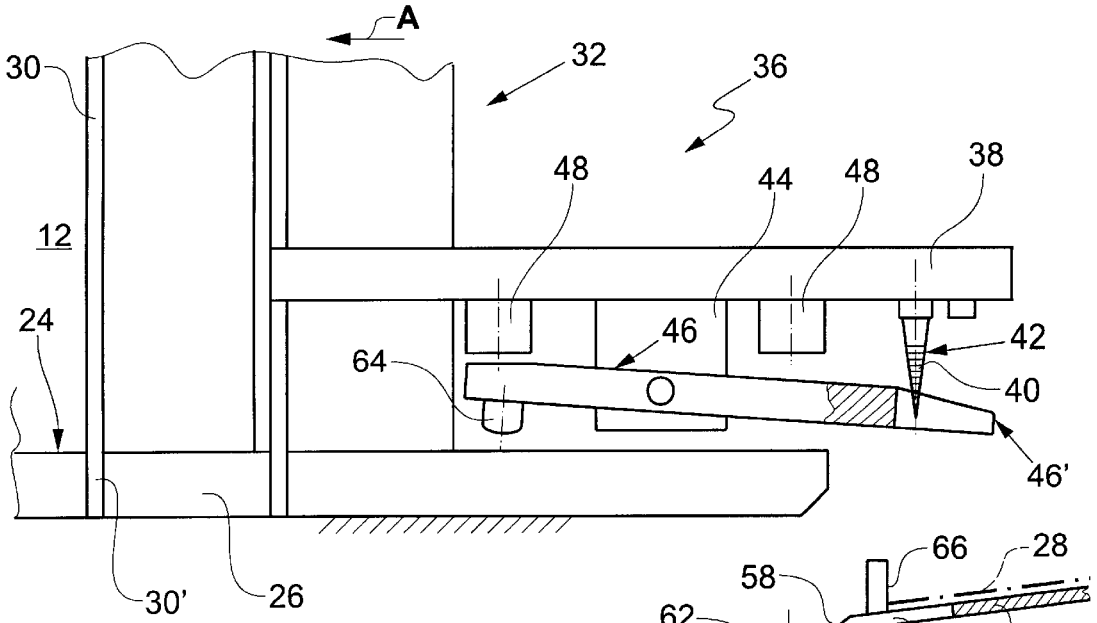
FIG. 4 shows, in a view enlarged with respect to FIG. 1, a part (designated by the arrow IV in FIG. 1) of the stacking apparatus with the ejector located in the starting position and a driving member, arranged thereon, before a cover sheet is picked up.
Figure 4:
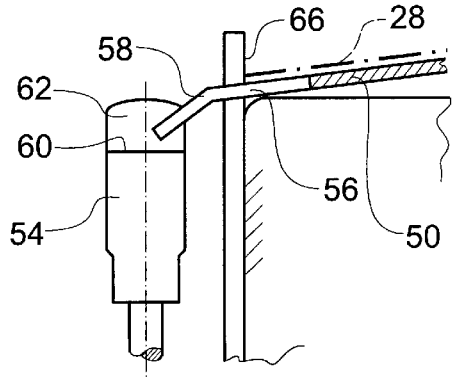

In order to make it possible to eject the stack 22 out of the stacking well 12, the angle sections 10 downstream in the ejection direction A are arranged to be moveable at right angles to the ejection direction A. In order to eject the stack 22 together with the cover sheet 28 out of the stacking well 12, there is a profile-like ejector 30, which in FIG. 1 is located in the standby position 32. As FIG. 3 also shows, it is arranged centrally between the upstream angle sections 10 and forms a tangent with the rectangularly based space bounded by said angle sections. The ejector 30 can be moved by a generally known drive, starting from the standby position 32, through the stacking well 12 in the ejection direction A and, along the movement path 34 (dash-dotted), around the outside of the stacking well 12, back into the standby position 32. In order to ensure that the cover sheet 28 is carried along reliably during the ejection operation, a tongue 30' protrudes from the ejector 30 into the free space between carrying rails 26 (FIG. 4). For the movement at right angles to the ejection direction A of the ejector 30, either the carrying rails 26 are interrupted, or these have grooves which permit the tongue 30' to move through them. The drive may have, for example, a bar which runs at right angles to the ejection direction A, to whose free end the ejector is fastened and which is mounted so that it can be displaced in its longitudinal direction on a carriage which can be driven in and counter to the ejection direction A.

Figure 5:
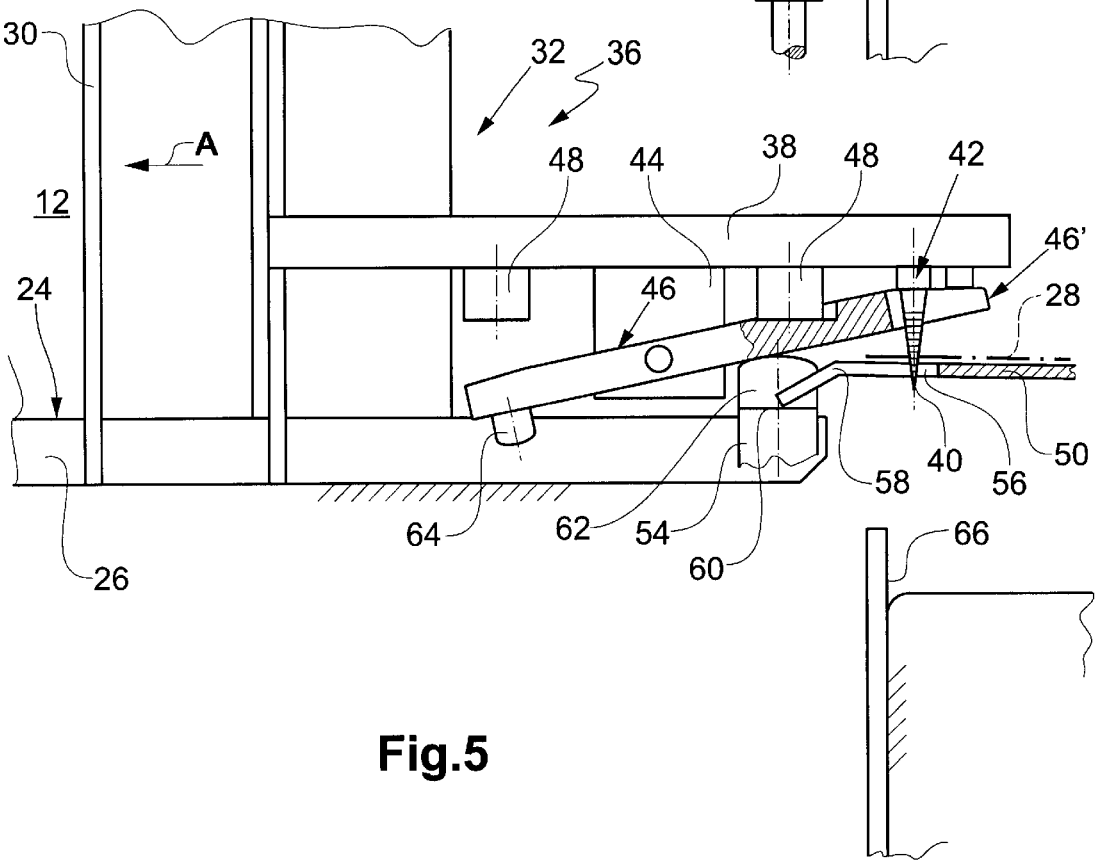
FIG. 5 shows, in an illustration identical to that in FIG. 4, the part, shown there, of the apparatus as a cover sheet is picked up.

In addition, the stacking apparatus has a device 36 for inserting one cover sheet 28 in each case into the stacking well 12, this device being shown enlarged in FIGS. 4 and 5. Fastened to the ejector 30 is a support 38 which projects from the latter in the direction opposite to the ejection direction A. Arranged on the support 38, in the free end region of the latter, is a gripping member 42 designed as a pointed driving pin 40. Between the downwardly pointing driving pin 40 and the ejector 30, a two-armed stripping lever 46 is mounted so that it can pivot on a plate 44 fastened to the support 38. Together with its end region on the side of the driving pin, said stripping lever 46 forms a stripping element 46' which is intended to strip a cover sheet 28 pinned onto the driving pin 40 off the driving pin 40. For this purpose, the stripping lever 46 is of forked design in the end region facing the driving pin 40, and engages around the driving pin 40.

A permanent magnet 48 is in each case arranged on the support 38 both between the driving pin 40 and the plate 44 and between the latter and the ejector 30. As a result, the magnetically conductive stripping lever 46 is pivotable, being held stably either in the stripping position shown in FIG. 4 or in the pick-up position shown in FIG. 5.

When the ejector 30 is located in the standby position 32, the driving pin 40 is in front of the start of the carrying rails 26, as viewed in the ejection direction A.

In addition, the insertion device 36 has a support plate 50 for one cover sheet 28 in each case, as emerges from the overall view of FIGS. 1, 4 and 5. At its upstream end, as viewed in the ejection direction A, said support plate is mounted so that it can pivot about a horizontal axis 52 which runs at right angles to the ejection direction A. In order to pin a cover sheet 28 lying on it onto the driving pin 40, the support plate 50 can be lifted, by means of a lifting element 54 operated by a piston/cylinder unit, out of a lowered rest position, which is shown dash-dotted in FIG. 1 and with continuous lines in FIG. 4, into a pinning position, illustrated with continuous lines in FIGS. 1 and 5, in which the driving pin 40 reaches through a corresponding cutout 56 in the support plate 50. This cutout 56 is bounded by tongue-like projections 58 from the support plate 50, which cooperate with a shoulder 60 on the lever element 54 in order to lift the support plate. Furthermore, the projections 58 are designed such that they can be moved through between two adjacent carrying rails 26. Between the shoulders 60, the lifting element 54 has a head 62 which is intended to pivot the stripping lever 46 into the pick-up position when the support plate 50 is lifted into the pinning position, as FIG. 5 shows.

At its end remote from the driving pin 40, the stripping lever 46 has an operating shoe 64 which, in the pick-up position of the stripping lever 46, engages in the space between the two abovementioned carrying rails 26.

In addition, the insertion device 36 has a stop 66 which is arranged in a stationary manner at the free end of the support plate 50 and which, when the support plate 50 is in the rest position, projects above the latter and serves as a stop for the leading edge of the cover sheet 28 which is in each case pushed in the ejection direction A onto the support plate 50.

FIG. 2 likewise shows the parts, illustrated in FIG. 1, of the stacking apparatus, but now the ejector 30 has been moved through the stacking well 12 in the ejection direction A, starting from the standby position 32 shown in FIG. 1, into an ejection position, in which the ejector 30 is located outside the stacking well 12 and the driving pin 40 is still located in the interior of the stacking well, at the downstream end of the latter. This position of the ejector 30 is assigned an operating element 68 which is intended to cooperate with the operating shoe 64. By means of a further piston/cylinder unit (not shown), said operating element 68 can be lifted out of a rest position arranged underneath the carrying rails 26, between the carrying rails 26, into an upper operating position, shown in FIG. 2, in which it pivots the stripping lever 46 from the pick-up position into the stripping position in order to strip off the relevant cover sheet 28.

Figure 6:
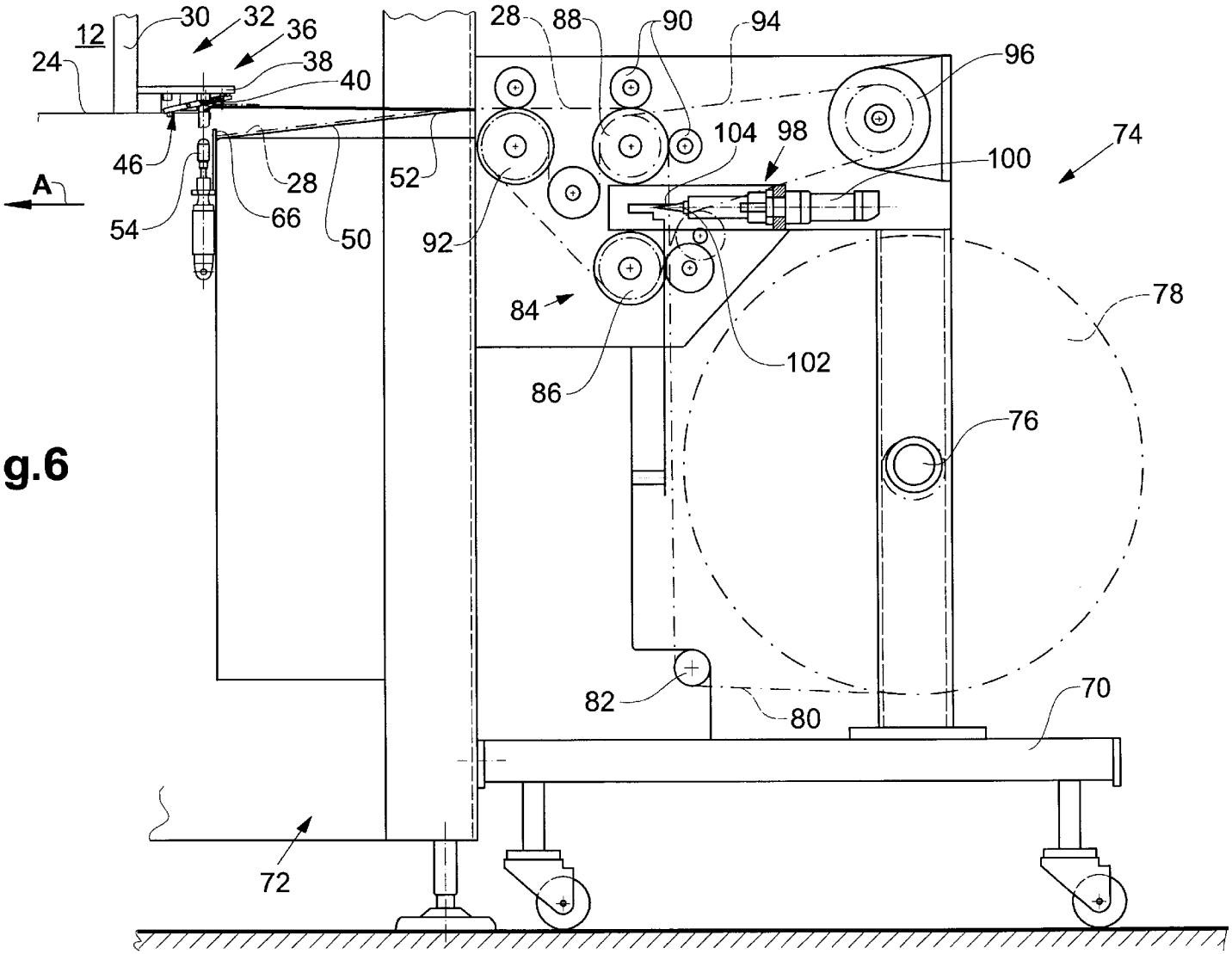
FIG. 6 shows a front view of a part of the stacking apparatus with a cover sheet feed device.

As shown in FIG. 6, the insertion device 36 is preceded by a cover sheet feed device 74. The latter has a moveable chassis 70 which can be brought into contact with the machine frame 72 of the stacking apparatus and fastened to said frame. Arranged on the chassis 70 is a bearing arrangement 76 for the rotatable mounting of a supply reel 78. The material web 80 which is wound up to form the supply reel 78 and is, for example, kraft paper or a plastic film, runs from the supply reel 78, around a deflection roll 82 and upward in the vertical direction from the latter to a conveying device 84. As viewed from the supply reel, in the direction of the material web 80, said conveying device 84 has a first pair of conveying rolls 86, a deflection roll 88 with two nip rolls 90 cooperating with the latter, and a second pair of conveying rolls 92. Around the deflection roll 88, the material web 80 between the two nip rolls 90 is deflected through 90° in the direction of the support plate 50 of the insertion device 36. Both the two pairs of conveying rolls 86, 92 and the deflection roll 88 are connected via a drive chain 94 to a drive motor 96 which is operated in start/stop mode. Between the first pair of conveying rolls 86 and the deflection roll 88 there is arranged a separating device 98 for the respective separation of a section forming a cover sheet 28 from the material web 80. With respect to the material web 80, the separating device 98 has on one side a cutting knife 102 which can be operated by means of a piston/cylinder unit 100 and, on the other side, a cutting edge 104 formed by a stationary section.

The cover sheet feed device 74 functions as follows. In each case once a cover sheet 28 has been pulled off the support plate 50 into the stacking well 12, the drive motor 96 is started. At the same time, on the one hand a section which has previously been separated from the material web 80 and forms the next cover sheet 28 is pushed onto the support plate 50 by means of the deflection roll 88 and the second pair of conveying rolls 92, until the leading edge of the cover sheet 28 rests against the stop 66 and, on the other hand, with the cutting knife 102 withdrawn, the material web is conveyed further by the length of a cover sheet 28, the leading edge of said material web running into the conveying gap formed by the deflection roll 88 and the upstream nip roll 90 and, by means of a guide plate (not shown), being inserted between the deflection roll 88 and the downstream nip roll 90, and likewise being guided between the second pair of conveying rolls 92 by guide elements (not shown). After the drive motor 96 has been stopped, the cutting knife 102 is advanced by means of the piston/cylinder 100 into the cutting position shown in FIG. 6 in order to sever the material web 80 with the cooperation of the cutting edge 104, and is then pulled back again.

As is indicated by the arrows 106 in FIG. 1, the cover sheet feed device may be assigned a labeling station, in order to apply a label to the respective cover sheet 28 on the upper or lower side.

The way in which the stacking apparatus functions will now be described in more detail with reference to FIGS. 1 to 5. As FIG. 4 shows, the cover sheet feed device 74 has conveyed a cover sheet 28 onto the support plate 50, lowered into the rest position. The cover sheet 28 is positioned by resting against the stop 66. The ejector 30 is in the standby position 32. As a result of the piston/cylinder unit shown in FIG. 4 being activated, the lifting element 54 is moved in the upward direction. In the process, on the one hand the support plate 50 is pivoted in the upward direction, as a result of which the cover sheet 28 lying on it is pinned onto the driving pin 40, and on the other hand the stripping lever 46 is pivoted into the pick-up position, as shown by FIG. 5. Then, by partially lowering the lifting element 54, the support plate 50 is moved into the horizontal position (shown by continuous lines in FIG. 1), in which it aligns with the well floor 24. As a result of a thread formed on the driving pin 40, or steps formed on the latter, the cover sheet 28 is kept pinned on, as is indicated dashdotted in FIG. 1.

Starting from the standby position 32, the ejector 30 is then moved through the stacking well 12 in the ejection direction A into the ejection position shown in FIG. 2. At the same time, on the one hand the cover sheet 28, together with the stack 22 arranged on it, is ejected out of the stacking well 12 and, on the other hand, a new cover sheet 28 is simultaneously pulled into the stacking well 12, sliding on the well floor 24. The operating element 68 is then lifted briefly in order to pivot the stripping lever 46 into the stripping position by acting on the operating shoe 64. In the process, the cover sheet 28 is stripped off the driving pin 40 and comes to lie completely on the well floor 24. The ejector 30 is then moved back around the stacking well 12, as is indicated in FIG. 3 by the movement path 34 shown dashdotted, into the standby position 32. While, in the stacking well 12, a new stack 22 is being deposited onto the cover sheet 28 located there, the next cover sheet 28 pushed onto the support plate 50, which has been completely lowered in the meantime, is pinned onto the driving pin 40 (see FIG. 2).

Of course, it is also conceivable to provide, instead of the driven operating element 68, a stationary slotted guide, onto which the operating shoe 64 runs toward the end of an ejection operation in order to pivot the stripping lever 46.

It is also possible to arrange the pick-up pin 40 to be moveable in relation to the support 38, in order to pin a cover sheet 28 on or to strip the latter off.

It is also conceivable to provide, instead of a driving pin 40 as the gripping member 42, a suction head arrangement which is moved together with the ejector 30.

In principle, it is also conceivable to insert the cover sheet 28 into the stacking well 12, sliding on the well floor 24, for example by means of pairs of conveying rollers.

The movement path of the ejector may have different forms. In particular, it is conceivable for the ejector also to be moved back into the standby position through the stacking well; in this case it must be ensured that the cover sheet or the undersheet remains unaffected.

That which is claimed:

1. An apparatus for stacking flat articles, such as newspapers, magazines and the like, comprising:

a stacking well which includes a well floor, an ejector, a drive for moving the ejector from a standby position which, as viewed in an ejection direction, is upstream of the stacking well through the stacking well, an insertion device for the lateral insertion of an undersheet into the lower end region of the stacking well in such a way that the undersheet comes to lie on the well floor, wherein the insertion device includes a gripping member mounted to the ejector for gripping the undersheet in the standby position of the ejector and, when the ejector is moved from the standby position through the stacking well for ejecting an earlier positioned undersheet together with a stack of articles arranged on said earlier positioned undersheet from the stacking well, pulling the gripped undersheet into the stacking well.

2. The apparatus as claimed in claim 1, wherein the gripping member comprises a driving pin which points downward and is adapted to pull an undersheet pinned on to it into the stacking well.

3. The apparatus as claimed in claim 2, further comprising a support plate which is arranged upstream of the stacking well, as viewed in the ejection direction, for receiving an undersheet thereupon, with said support plate being moveable between a lowered rest position and a raised position wherein the undersheet received thereon is pinned onto said driving pin, when the ejector is in the standby position.

4. The apparatus as claimed in claim 3, wherein said insertion device further includes a stripping element mounted to the ejector, and an operating member for controlling the stripping element so as to operate the stripping element at the downstream end of the stacking well in order to strip the undersheet off the driving pin.

5. The apparatus as claimed in claim 4, wherein the stripping element comprises a stripping lever which is pivotally mounted on the ejector and which can be pivoted into a stripping position by means of the operating member, and pivoted into a rest position.

6. The apparatus as claimed in claim 5 wherein said support plate is moveable from said lowered position to said raised position by a lifting drive, and wherein the stripping lever is positioned so that it is engaged by the support plate when the support plate is lifted to its raised position by said lifting device to thereby pivot the stripping lever to its rest position.

7. The apparatus as claimed in claim 1, further comprising an undersheet feed device having a bearing arrangement for a supply reel of a material web, a separating device for separating sections which in each case form an undersheet from the material web pulled off the supply reel, and a conveying device for pulling the material web off the supply reel and conveying each section to the insertion device.

8. The apparatus as claimed in claim 1, further comprising a drive for moving the ejector from the standby position, through the stacking well and back around the stacking well to the standby position.

9. A method of stacking flat articles, such as newspapers, magazines and the like, comprising the steps of forming a vertical stack of the flat articles, upon an undersheet which overlies a well floor, advancing an ejector in an ejection direction from a standby position which is on one side of the well floor across the well floor so as to eject the stack of flat articles and the undersheet from the well floor, and while the ejector grips a second undersheet so that the second undersheet is pulled to a location overlying the well floor as the ejector advances, and then releasing the second undersheet from the ejector and returning the ejector to the standby position so that the second undersheet remains overlying the well floor and ready to receive a second stack of flat articles thereupon.

* * * * *